US010265991B2

(12) United States Patent
Hoarau et al.

(10) Patent No.: US 10,265,991 B2
(45) Date of Patent: Apr. 23, 2019

(54) TECHNIQUES FOR CREASING A COVER OF A CASE

(75) Inventors: Eric Hoarau, San Francisco, CA (US); Kimberly Ann Pratten, San Diego, CA (US); Gary James Watts, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 775 days.

(21) Appl. No.: 14/398,024

(22) PCT Filed: May 1, 2012

(86) PCT No.: PCT/US2012/035991

§ 371 (c)(1),
(2), (4) Date: Oct. 30, 2014

(87) PCT Pub. No.: WO2013/165397

PCT Pub. Date: Nov. 7, 2013

(65) Prior Publication Data

US 2015/0110579 A1 Apr. 23, 2015

(51) Int. Cl.

| | |
|---|---|
| ***B42C 9/00*** | (2006.01) |
| ***B42C 7/00*** | (2006.01) |
| ***B42C 13/00*** | (2006.01) |
| ***B42B 9/00*** | (2006.01) |
| ***B42C 11/04*** | (2006.01) |
| ***B42D 3/00*** | (2006.01) |

(52) U.S. Cl.

CPC ..... *B42C 7/005* (2013.01); *B42C 11/04* (2013.01); *B42C 13/003* (2013.01); *B42D 3/002* (2013.01)

(58) Field of Classification Search

CPC ..... B42C 7/005; B42C 13/003; B42C 11/04; B42D 3/002

USPC ..... 412/9, 17, 22, 23

See application file for complete search history.

(56) References Cited

U.S. PATENT DOCUMENTS

| | | | | |
|---|---|---|---|---|
| 4,367,061 | A | 1/1983 | Wiholm | |
| 5,044,857 | A * | 9/1991 | Crudo | B42C 11/04 281/15.1 |
| 5,062,754 | A | 11/1991 | Bolin et al. | |
| 7,794,169 | B2 | 9/2010 | Sasamoto et al. | |
| 2006/0072983 | A1 * | 4/2006 | Muller | B42C 19/00 412/22 |
| 2006/0182484 | A1 | 8/2006 | Xie et al. | |

(Continued)

FOREIGN PATENT DOCUMENTS

| | | |
|---|---|---|
| CN | 2414911 | 1/2001 |
| JP | 2007062142 | 3/2007 |
| KR | 20-0411635 Y1 | 3/2006 |

OTHER PUBLICATIONS www.creasestream.com/junior.

(Continued)

*Primary Examiner* — Justin V Lewis

(74) *Attorney, Agent, or Firm* — Dicke Billig & Czaja PLLC

(57) ABSTRACT

Techniques for creasing a cover of a case are described herein. In an example, a creasing tool includes a first plate portion and a second plate portion substantially parallel to the first plate portion such that the first plate portion and the second plate portion define a slot between the first plate portion and the second plate portion for creasing a cover of a case.

10 Claims, 8 Drawing Sheets

(56) References Cited

U.S. PATENT DOCUMENTS

| | | | |
|---|---|---|---|
| 2007/0280805 | A1 | 12/2007 | Sasamoto et al. |
| 2009/0035093 | A1 | 2/2009 | Takagi et al. |
| 2009/0324365 | A1 | 12/2009 | Bourdelain |
| 2010/0111643 | A1 | 5/2010 | Schmidkonz |

OTHER PUBLICATIONS www.creasetream.com/mini.
International Searching Authority, International Search Report dated Feb. 27, 2013. Application No. PCT/US2012/035991 Filing date May 1, 2012.

* cited by examiner

TECHNIQUES FOR CREASING A COVER OF A CASE

BACKGROUND

Custom photo-books, scrapbooks, and other custom books are conventionally manufactured in a factory setting where highly skilled workers use specialized power tools, which are typically automated, to build the photo-book, scrapbook, or other custom book. The custom book may include custom cover art, such as a photo or other printed material. The cover of the custom book is conventionally creased by a specialized power tool so that the book can be opened and closed without damaging the cover or the custom cover art. A low cost method of creating custom books including custom cover art in a retail environment using unskilled workers, however, is currently lacking.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "upper," "lower," "above," "below," etc., is used with reference to the orientation of the Figure(s) being described. Because components of examples can be positioned in a number of different orientations, the directional terminology is used for purposes of illustration and is in no way limiting. It is to be understood that other examples may be utilized and structural changes may be made without departing from the scope of the present disclosure. The following detailed description, therefore, is not to be taken in a limiting sense, and the scope of the present disclosure is defined by the appended claims. It is to be understood that features of the various examples described herein may be combined with each other, unless specifically noted otherwise.

Figure 1A:
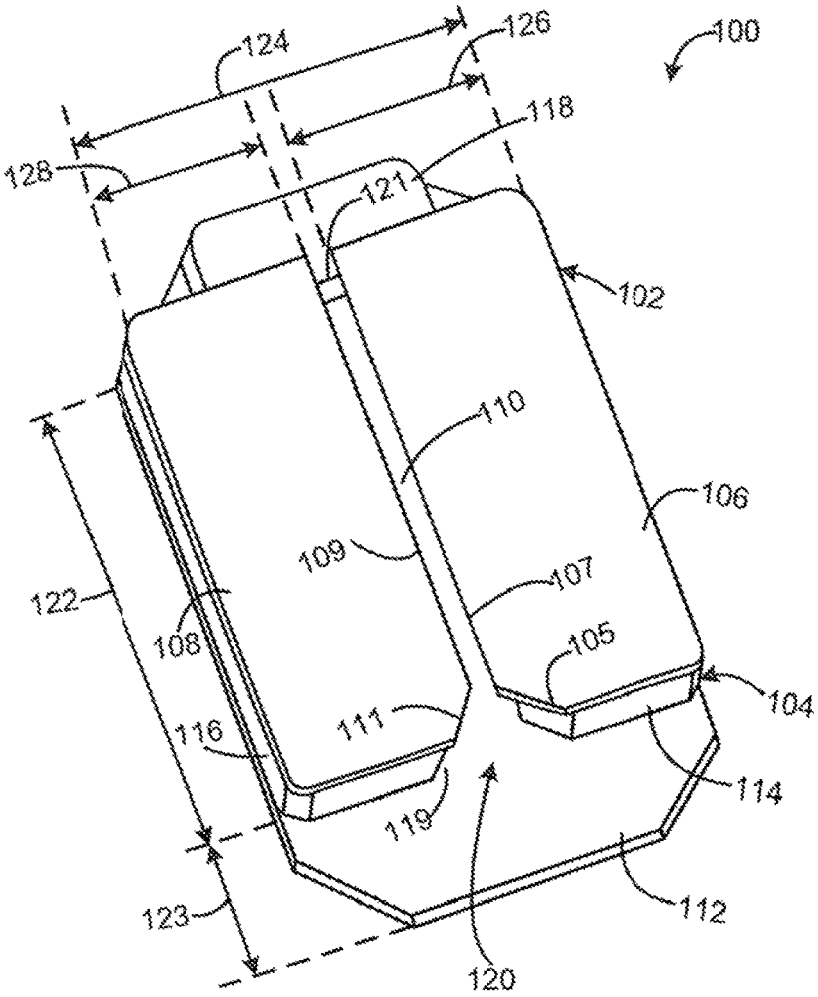
FIG. 1A illustrates a perspective view of one example of a creasing tool.
Figure 1B:
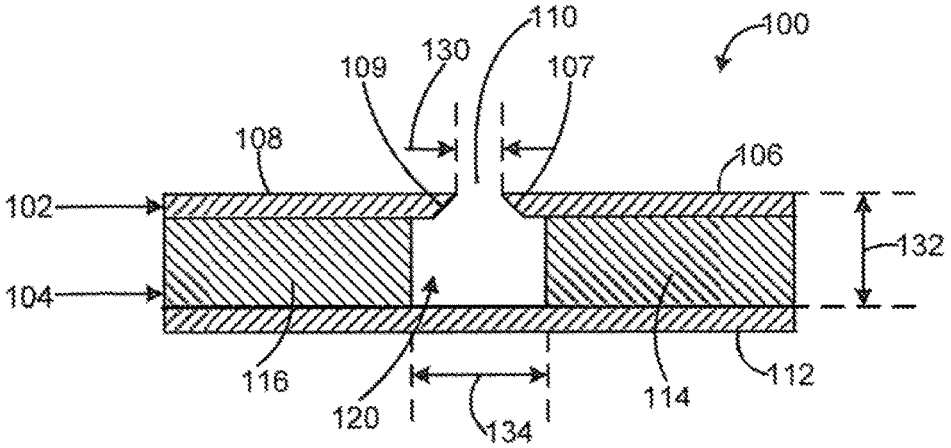
FIG. 1B illustrates a cross-sectional view of one example of a creasing tool.

FIG. 1A illustrates a perspective view and FIG. 1B illustrates a cross-sectional view of one example of a creasing tool 100. In one example, creasing tool 100 is used for creasing a cover of a case for a custom book, such as a photo-book or scrapbook. Creasing tool 100 is a low cost tool that can be used by unskilled workers in a retail environment to produce a professional looking custom wrapped hardboard photo-book or other custom book.

Figure 10:
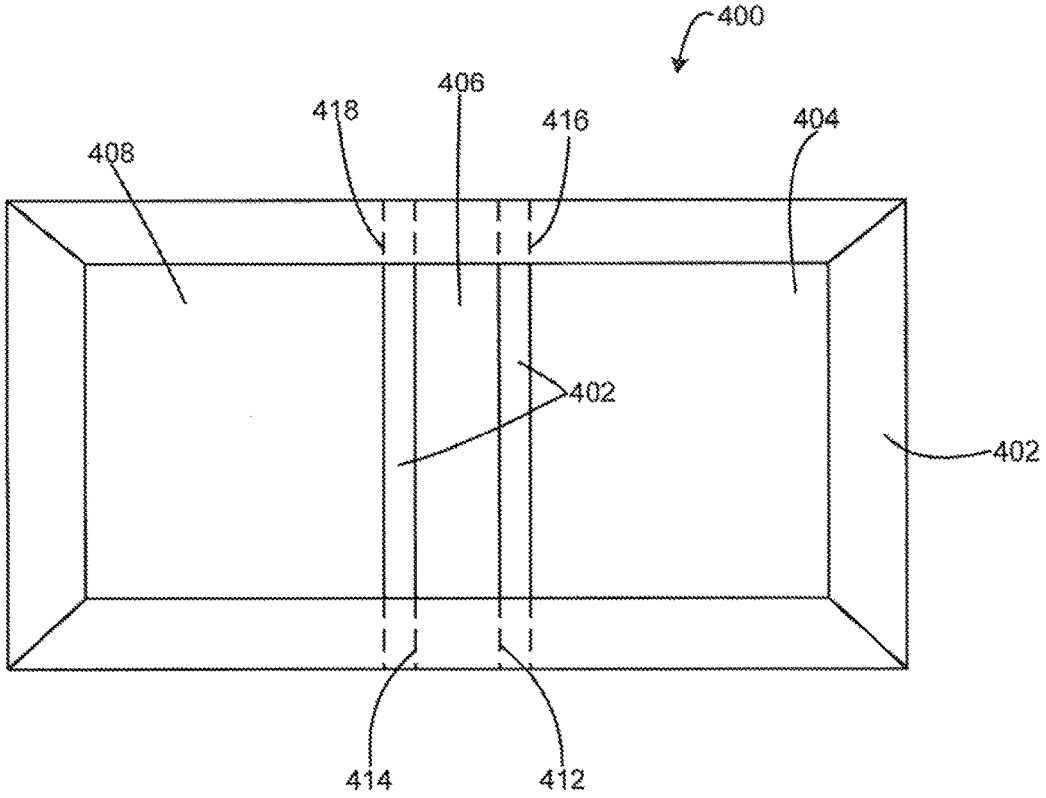
FIG. 10 illustrates a top view of one example of a case of a custom book manufactured according to an example.

One example of a case including a cover that may be creased by creasing tool 100 is illustrated in FIG. 10. Case 400 includes a first surface board 404, a spine board 406, and a second surface board 408. Spine board 406 is substantially parallel to and spaced apart from first surface board 404 and second surface board 408. A cover 402 is bonded to first surface board 404, spine board 406, and second surface board 408. In this example, cover 402 wraps around the outer edges of first surface board 404, spine board 406, and second surface board 408. To use case 400 for a custom book, case 400 is creased at the edges of spine board 406 as indicated at 412 and 414, at the inner edge of first surface board 404 as indicated at 416, and at the inner edge of second surface board 408 as indicated at 418. In one example, creases 412 and 414 are creased by hand, and creases 416 and 418 are creased by a creasing tool, such as creasing tool 100.

Creasing tool 100 includes a creasing plate 102 and a base 104. Creasing plate 102 includes a first plate or first plate portion 106 and a second plate or second plate portion 108, which is substantially parallel to first plate or first plate portion 106. First plate 106 includes an edge 107 and second plate 108 includes an edge 109, which is substantially parallel to edge 107 of first plate 106. Edge 107 of first plate 106 and edge 109 of second plate 108 define a slot 110 between first plate 106 and second plate 108. In one example, edge 107 of first plate 106 is beveled and edge 109 of second plate 108 is beveled. In other examples, edge 107 of first plate 106 and edge 109 of second plate 108 have other suitable shapes.

In one example, first plate portion 106 includes a notched region 105 at one end of edge 107 and second plate portion 108 includes a notched region 111 at one end of edge 109. Notched region 105 of first plate 106 is directly opposite notched region 111 of second plate 108 to provide a V-shaped guide to slot 110.

Base 104 includes a first base portion 112, a second base portion 114, and a third base portion 116. In one example, base 104 also includes a fourth base portion 118. The lower side of second base portion 114 and the lower side of third base portion 116 are coupled to the upper side of first base portion 112. In one example, the lower side of fourth base portion 118 is also coupled to the upper side of first base portion 112. The upper side of second base portion 114 is coupled to the lower side of first plate 106 such that edge 107 of first plate 106 overhangs second base portion 114. The upper side of third base portion 116 is coupled to the lower side of second plate 108 such that edge 109 of second plate 108 overhangs third base portion 116.

First base portion 112, second base portion 114, and third base portion 116 define a channel 120 substantially centered below slot 110. The bottom of channel 120, which is substantially parallel to creasing plate 102, is defined by first base portion 112. The sidewalls of channel 120, which are substantially perpendicular to creasing plate 102, are defined by second base portion 114 and third base portion 116. Channel 120 is open at end 119 where notched region 105 of first plate 106 and notched region 107 of second plate 108 are located. In one example, where fourth base portion 118 is excluded, channel 120 is also open at the other end 121 opposite end 119. In another example, fourth base portion 118 at least partially closes channel 120 at end 121 and provides a stop for a case inserted into creasing tool 100.

In one example, creasing plate 102 and base portion 104 are made of the same material, such as plastic or metal. In another example, creasing plate 102 and base portion 104 are made of different materials. For example, creasing plate 102 may be made of a hard material, such as plastic or metal, and base 104 may be made of a resilient foam or dense foam material. In another example, first base portion 112 is made of a hard material, such as plastic or metal, and second base portion 114 and third base portion 116 are made of a resilient foam or dense foam material.

In one example, creasing plate 102 and base portion 104 are integral to each other and fabricated in one part, such as by injection molding, machining, or 3D printing. In other examples, creasing plate 102 (or first plate 106 and second plate 108) and base portion 104 (or first base portion 112, second base portion 114, and third base portion 116) are separate parts that are coupled to each other via adhesive material, screws, clamps, rivets, or other suitable coupling means.

In one example, first base portion 112 includes an extended portion as indicated by length 123. The extended portion of first base portion 112 assists in guiding a case into channel 120 of creasing tool 100. In one example, the extended portion of first base portion 112 has a length 123 between 1 cm and 10 cm. In other examples, the extended portion of first base portion 112 is excluded.

Creasing plate 102 has a length as indicated at 122 and a width as indicated at 124. First plate 106 and second plate 108 have length 122. First plate 106 has a width as indicated at 126 and second plate 108 has a width as indicated at 128. In one example, width 126 of first plate 166 is substantially equal to width 128 of second plate 108. In one example, length 122 is between 10 cm and 50 cm, such as 30 cm. In one example, width 124 is between 10 cm and 30 cm, such as 20 cm. In one example, width 126 and width 128 are between 3 cm and 20 cm, such as 10 cm. In other examples, length 122 and widths 126 and 128 are selected based on the dimensions of the case that will be creased using creasing tool 100.

Slot 110 has a width as indicated at 130. Channel 120 has a width as indicated at 134 and a height as indicated at 132. The width 130 of slot 110 is less than the width 134 of channel 120. In one example, slot 110 has a width 130 between 2 mm and 10 mm, such as 6 mm. In one example, channel 120 has a width 134 between 4 mm and 30 mm, such as 12 mm, and a height 132 between 4 mm and 16 mm, such as 12 mm. In other examples, width 130 of slot 110, width 134 of channel 120, and height 132 of channel 120 are selected based on the dimensions of the case that will be creased using creasing tool 100.

In operation, as described in more detail below with reference to FIGS. 8A-8D, a case including a cover bonded to a spine board and two surface boards is slid into slot 110 of creasing tool 100 such that the spine board is received within channel 120 and the two surface boards are above creasing plate 102. The case is then opened and one surface board is pressed against first plate 106 and the other surface board is pressed against second plate 108 to crease the cover at edge 107 and at edge 109, respectively. The case is then removed from creasing tool 100.

Figure 2:
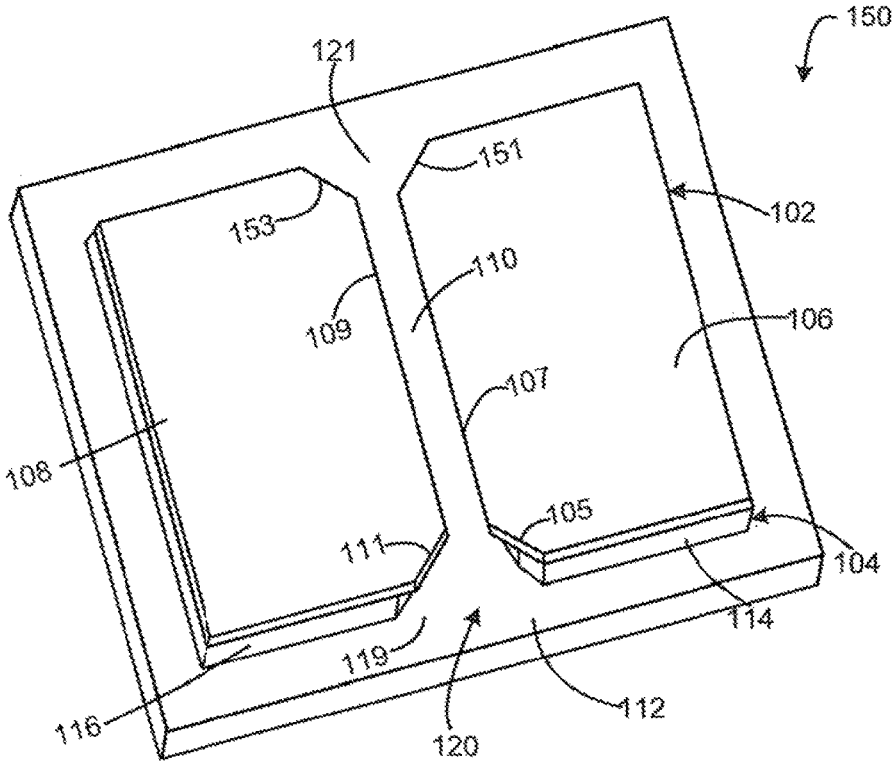
FIG. 2 illustrates a perspective view of another example of a creasing tool.

FIG. 2 illustrates a perspective view of another example of a creasing tool 150. Creasing tool 150 is similar to creasing tool 100 previously described and illustrated with reference to FIGS. 1A and 1B, except that creasing tool 150 is designed for scoring/creasing the cover of a case without opening the case within the creasing tool. In this example, the case is slid through slot 110 of creasing tool 150 to score/crease the cover.

Creasing tool 150 includes a creasing plate 102 and a base 104 similar to creasing tool 100, however, in this example, first plate 106 also includes a notched region 151 at the end of edge 107 opposite notched region 105 and second plate 108 includes a notched region 153 at the end of edge 109 opposite notched region 111. Notched region 151 of first plate 106 is directly opposite notched region 153 of second plate 108 to provide a V-shaped guide to slot 110. Thus, creasing plate 102 of creasing tool 150 includes a V-shaped guide to slot 110 at both ends 119 and 121 of channel 120.

In one example, first plate 106 or second plate 108 is spring loaded in a direction substantially parallel to first plate 106 or second plate 108. In another example, both first plate 100 and second plate 108 are spring loaded in a direction substantially parallel to first plate 106 and second plate 108. The spring loaded plate or plates exert pressure on a case when the case is inserted into slot 110. Thus, the covers of cases having various dimensions and thicknesses may be scored/creased by creasing tool 150.

In operation, a case including a cover bonded to a spine board and two surface boards is slid into one end of slot 110 of creasing tool 150 such that the spine board is received within channel 120 and the two surface boards are above creasing plate 102. The case is slid out the other end of creasing tool 150. If desired, the process may be repeated. As a result of sliding the case through creasing tool 150, the cover of the case is scored/creased by edge 107 and by edge 109.

Figure 3:
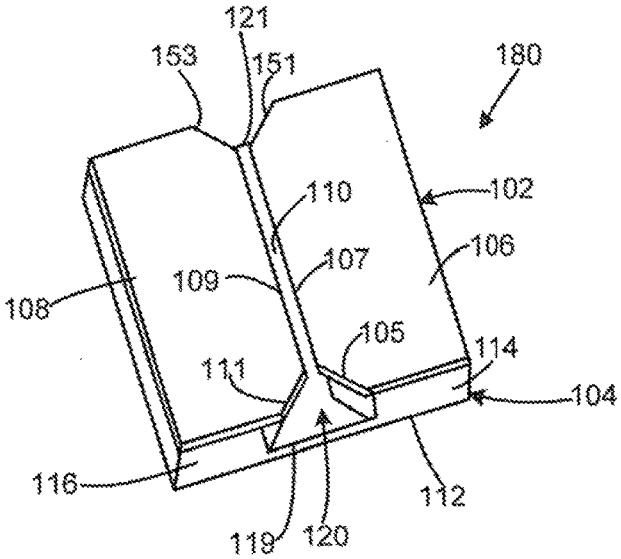
FIG. 3 illustrates a perspective view of another example of a creasing tool.

FIG. 3 illustrates a perspective view of another example of a creasing tool 180. Creasing tool 180 is similar to creasing tool 150 previously described and illustrated with reference to FIG. 2, except that creasing tool 180 is dimensioned for handheld use. In this example, first base portion 112, second base portion 114, and third base portion 116 of base 104 are formed in one part suitable for grasping in one hand. In operation, in this example, creasing tool 180 is slid over the case rather than the case being slide through the creasing tool.

Figure 4:
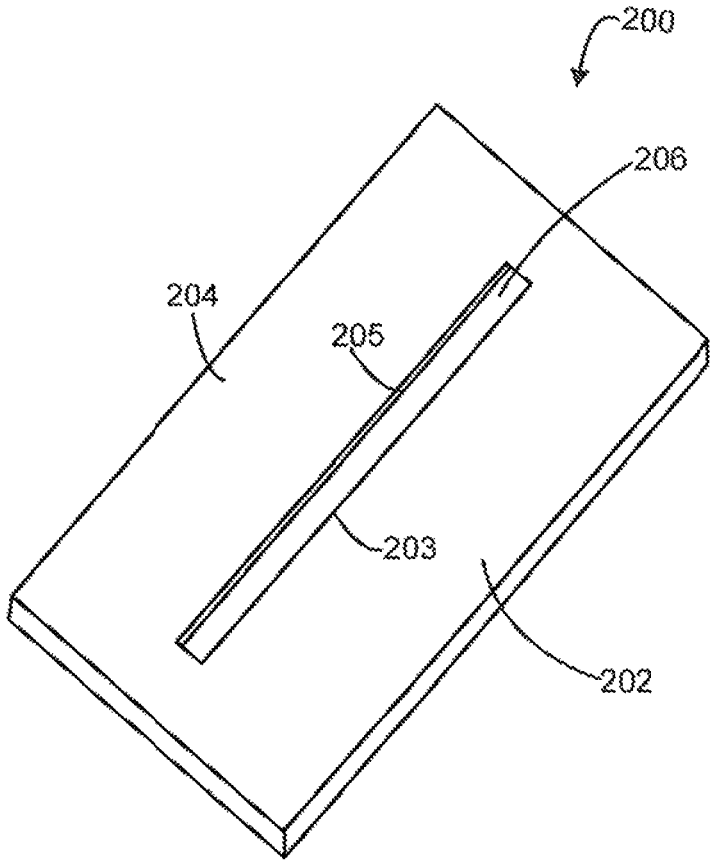
FIG. 4 illustrates a perspective view of another example of a creasing tool.

FIG. 4 illustrates a perspective view of another example of a creasing tool 200. Creasing tool 200 is formed by a single plate having a slot 206 therein. Creasing tool 200 includes a first plate portion 202 and a second plate portion 204, which is substantially parallel to first plate portion 202. First plate portion 202 includes an edge 203 and second plate portion 204 includes an edge 205, which is substantially parallel to edge 203 of first plate portion 202. Edge 203 of first plate portion 202 and edge 205 of second plate portion 204 define slot 206 between first plate portion 202 and second plate portion 204. In one example, edge 203 of first plate portion 202 is beveled and edge 205 of second plate portion 204 is beveled. In other examples, edge 203 of first plate portion 202 and edge 205 of second plate portion 204 have other suitable shapes.

In operation, as described in more detail below with reference to FIGS. 9A-9D, a case including a cover bonded to a spine board and two surface boards is inserted into slot 206 of creasing tool 200 such that the spine board is below creasing tool 200 and the two surface boards are above creasing tool 200. The case is then opened and one surface board is pressed against first plate portion 202 and the other surface board is pressed against second plate portion 204 to crease the cover at edge 203 and at edge 205, respectively. The case is then removed from creasing tool 200.

Figure 5A:
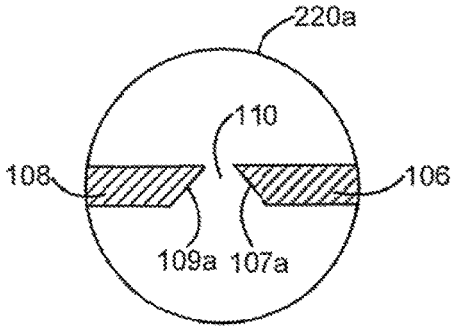
FIG. 5A illustrates a magnified cross-sectional view of one example of a slot of a creasing tool.

FIG. 5A illustrates a magnified cross-sectional view 220*a* of one example of a slot 110 of a creasing tool 100 (FIGS. 1A and 1B), a creasing tool 150 (FIG. 2), or a creasing tool 180 (FIG. 3). The magnified cross-sectional view 220*a* is also applicable to a slot 206 of a creasing tool 200 (FIG. 4). In this example, edge 107*a* of first plate 106 is beveled and edge 109*a* of second plate 108 is beveled. Beveled edge 107*a* will form one crease on a cover where edge 107*a* intercepts the top surface of first plate 106. Beveled edge 109*a* will form another crease on a cover where edge 109*a* intercepts the top surface of second plate 108.

Figure 5B:
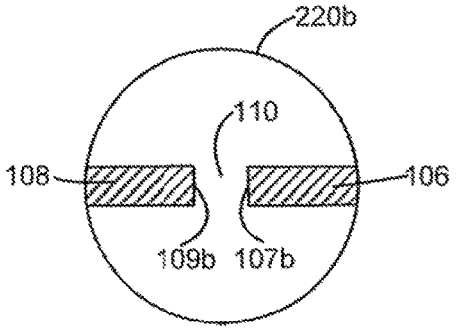
FIG. 5B illustrates a magnified cross-sectional view of another example of a slot of a creasing tool.

FIG. 5B illustrates a magnified cross-sectional view 220*b* of another example of a slot 110 of a creasing tool 100 (FIGS. 1A and 1B), a creasing tool 150 (FIG. 2), or a creasing tool 180 (FIG. 3). The magnified cross-sectional view 220*a* is also applicable to a slot 206 of a creasing tool 200 (FIG. 4). In this example, edge 107*b* of first plate 106 is substantially perpendicular to the top surface of first plate 106 and edge 109*b* of second plate 108 is substantially perpendicular to the top surface of second plate 108. Edge 107*b* will form two creases on a cover, one crease where edge 107*b* intercepts the top surface of first plate 106 and another crease where edge 107*b* intercepts the bottom surface of first plate 106. Edge 109*b* will form another two creases on a cover, one crease where edge 109*b* intercepts the top surface of second plate 108 and another crease where edge 109*b* intercepts the bottom surface of second plate 108.

Figure 6A:
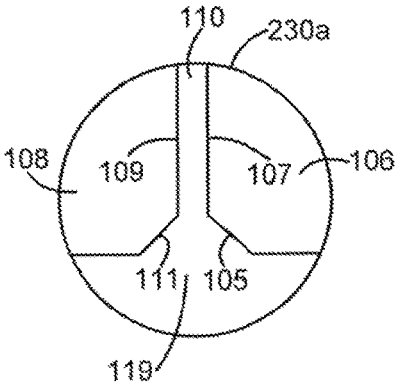
FIG. 6A illustrates a magnified top view of one example of an end of a slot of a creasing tool.

FIG. 6A illustrates a magnified top view 230*a* of one example of an end 119 of a slot 110 of a creasing tool 100 (FIGS. 1A and 1B), a creasing tool 150 (FIG. 2), or a creasing tool 180 (FIG. 3). This example is also applicable to end 121 of slot 110 of a creasing tool 150 (FIG. 2) or a creasing tool 180 (FIG. 3). In this example, first plate portion 106 includes a notched region 105 at one end of edge 107 and second plate portion 108 includes a notched region 111 at one end of edge 109. Notched region 105 of first plate 106 is directly opposite notched region 111 of second plate 108 to provide a V-shaped guide to slot 110 at end 119. The V-shaped guide to slot 110 assists in sliding a case into the creasing tool.

Figure 6B:
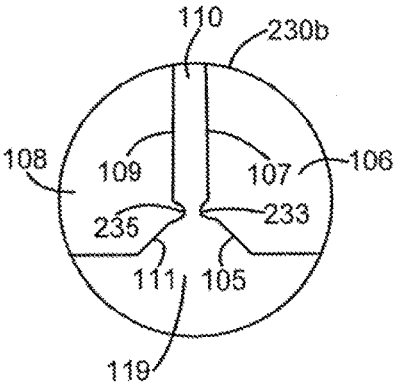
FIG. 6B illustrates a magnified top view of another example of an end of a slot of a creasing tool.

FIG. 6B illustrates a magnified top view 230*b* of another example of an end 119 of a slot 110 of a creasing tool 100 (FIGS. 1A and 1B), a creasing tool 150 (FIG. 2), or a creasing tool 180 (FIG. 3). This example is also applicable to end 121 of slot 110 of a creasing tool 150 (FIG. 2) or a creasing tool 180 (FIG. 3). This example is similar to the example previously described and illustrated with reference to FIG. 6A, except that in this example, first plate 106 includes a nipping portion 233 and second plate 108 includes a nipping portion 235. Nipping portion 233 extends from edge 107 of first plate 106 at the inner end of notched region 105. Nipping portion 235 extends from edge 109 of second plate 108 at the inner end of notched region 111 and is directly opposite to nipping portion 233. In one example, nipping portions 233 and 235 exert an additional force on the cover when a case is slid into the creasing tool, thus increasing the depth of the scoring/creasing. In other examples, additional nipping portions extend from edge 107 of first plate 106 and from edge 109 of second plate 108 along the length of slot 110.

Figure 6C:
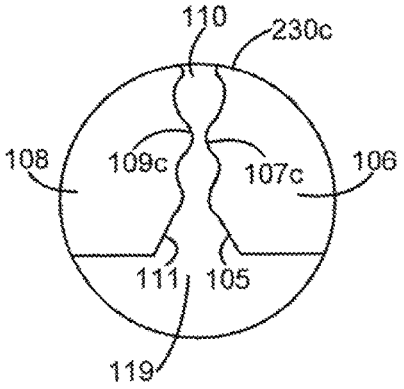
FIG. 6C illustrates a magnified top view of another example of an end of a slot of a creasing tool.

FIG. 6C illustrates a magnified top view 230*c* of another example of an end 119 of a slot 110 of a creasing tool 100 (FIGS. 1A and 1B), a creasing tool 150 (FIG. 2), or a creasing tool 180 (FIG. 3). This example is also applicable to end 121 of slot 110 of a creasing tool 150 (FIG. 2) or a creasing tool 180 (FIG. 3). This example is similar to the example previously described and illustrated with reference to FIG. 6A, except that in this example, edge 107*c* of first plate 106 includes a pattern of recessed portions and nipping portions and edge 109*c* of second plate 108 includes a pattern of recessed portions and nipping portions. In one example, the pattern of edge 107*c* of first plate 106 is mirror symmetrical to the pattern of edge 109*c* of second plate 108. In one example, the pattern of edge 107*c* and the pattern of edge 109*c* exert an additional force on the cover when a case is slid into the creasing tool, thus increasing the depth of the scoring/creasing. In one example, the pattern of edge 107*c* and the pattern of edge 109*c* extend along the entire length of slot 110.

Figure 7:
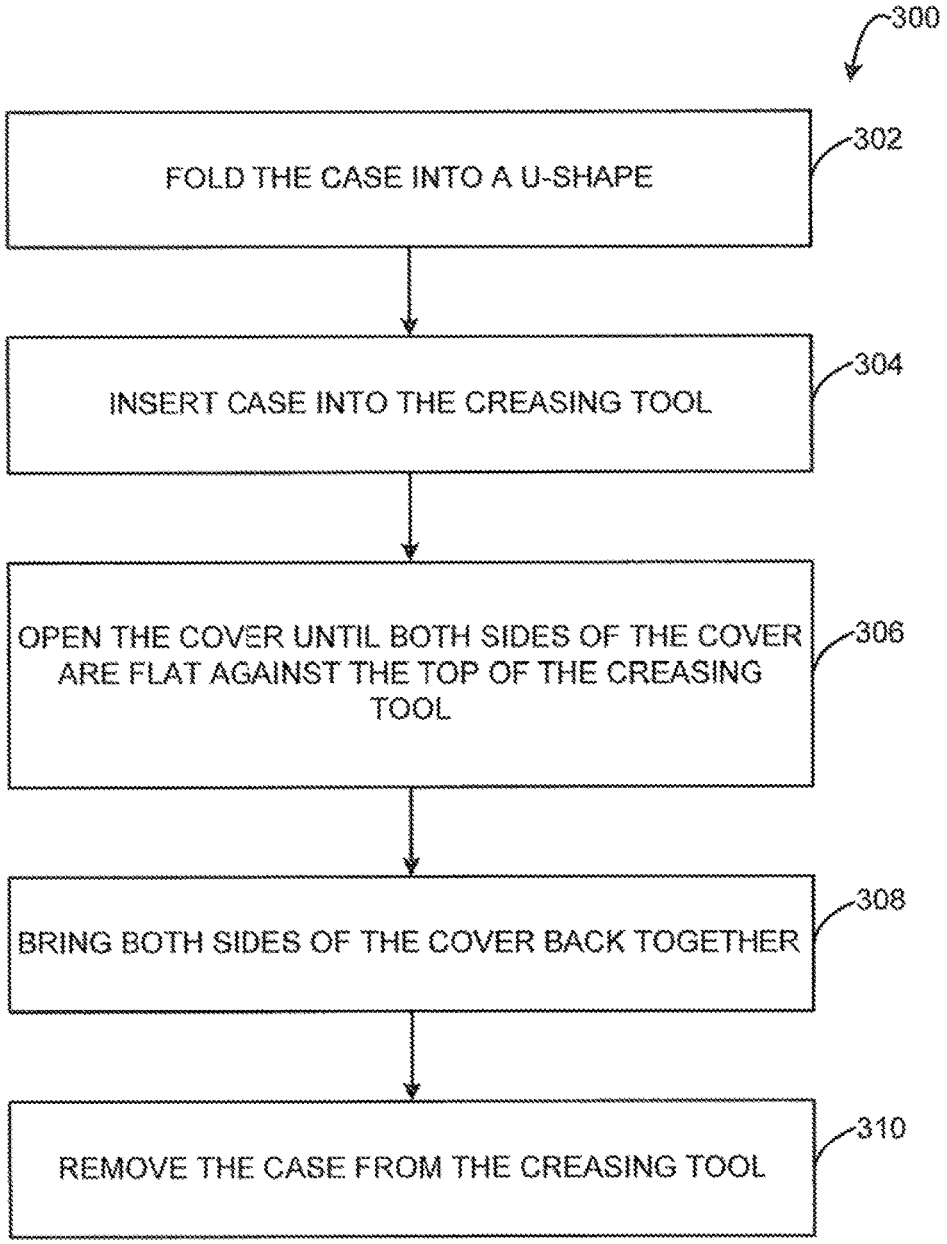
FIG. 7 is a flow diagram illustrating one example of a process for creasing a cover of a case using a creasing tool.

FIG. 7 is a flow diagram illustrating one example of a process 300 for creasing a cover of a case, such as case 400 (FIG. 10) using a creasing tool. In one example, process 300 is used for manufacturing a custom book, such as a photo-book. At 302, the case is folded into a U-shape. At 304, the case is inserted into the creasing tool, such as creasing tool 100 (FIGS. 1A and 1B), creasing tool 150 (FIG. 2), creasing tool 180 (FIG. 3), or creasing tool 200 (FIG. 4). At 306, the case is opened so that both sides of the cover are flat against the top of the creasing tool. At 308, both sides of the cover are brought back together. In one example, for creasing tool 150 (FIG. 2) and creasing tool 180 (FIG. 3), steps 306 and 308 may be skipped. At 310, the case is removed from the creasing tool.

The following FIGS. 8A-8D illustrate one example of a process for creasing a cover of a case using creasing tool 100 previously described and illustrated with reference to FIGS. 1A and 1B.

Figure 8A:
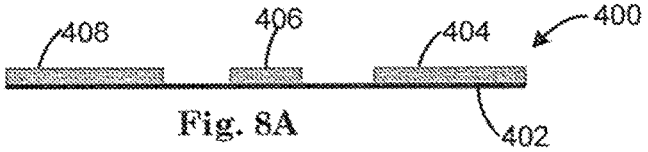
FIG. 8A illustrates a cross-sectional view of one example of a case including a cover prior to creasing the cover.

FIG. 8A illustrates a cross-sectional view of one example of a case 400 including a cover 402 prior to creasing the cover 402. Case 400 includes a first surface board 404, a spine board 406, a second surface board 408, and cover 402. Cover 402 is bonded to first surface board 404, spine board 406, and second surface board 408 via an adhesive material. In one example, cover 402 includes a transparent sheet, a paper-like sheet (or another suitable flexible material) holding first surface board 404, spine board 406, and second surface board 408 together, and a custom printed sheet between the transparent sheet and the paper-like sheet. The transparent sheet may be wrapped to form a pocket into which the custom printed sheet may be inserted. In one example, the custom printed sheet is a photo for a photo-book cover. In one example, the transparent sheet is laminated over the custom printed sheet, the paper-like sheet, first surface board 404, spine board 406, and second surface board 408 to provide a professional looking custom wrapped hardboard case for a photo-book or other custom book.

Figure 8B:
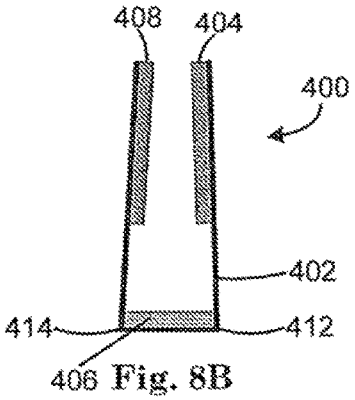
FIG. 8B illustrates a cross-sectional view of one example of the case after creasing the cover at the edges of the spine board.

FIG. 8B illustrates a cross-sectional view of one example of case 400 after creasing cover 402 at the edges of spine board 406. The case is folded into a U-shape such that a first crease is formed at 412 at a first edge of spine board 406 and a second crease is formed at 414 at a second edge of spine board 406. In one example, the paper-like sheet of cover 402 is perforated at 412 and 414 to reduce the stress on cover 402 at creases 412 and 414. In one example, cover 400 is folded into the U-shape by hand.

Figure 8C:
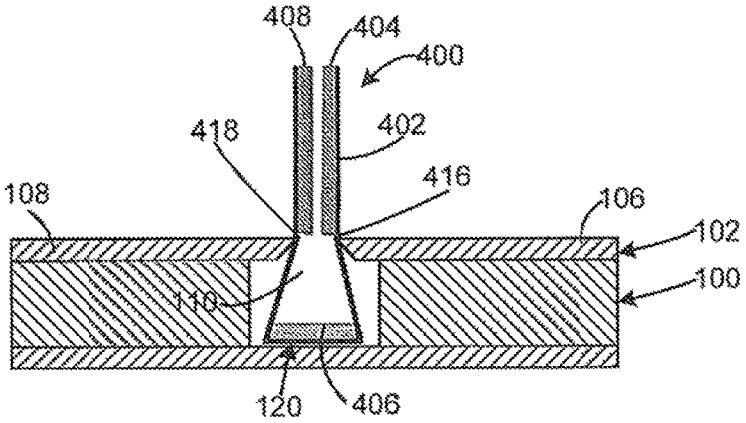
FIG. 8C illustrates a cross-sectional view of one example of the case after sliding the case into a creasing tool.

FIG. 8C illustrates a cross-sectional view of one example of case 400 after sliding case 400 into creasing tool 100. Case 400 is slid into slot 110 of creasing tool 100 such that spine board 406 is on one side of slot 110 within channel 120 and first surface board 404 and second surface board 408 are on the other side of slot 110 above creasing plate 102. First surface board 404 and second surface board 408 are substantially perpendicular to spine board 406, which is substantially parallel to creasing plate 102. Due to channel 120 and slot 110, spine board 406 and the portion of cover 402 within channel 120 form a triangular shape that self-aligns cover 402 within creasing tool 100. In this way, the edge of first plate 106 contacts one side of cover 402 at 416 at or below the inner end of first surface board 404. Likewise, the edge of second plate 108 contacts the other side of cover 402 at 418 at or below the inner end of second surface board 408.

Figure 8D:
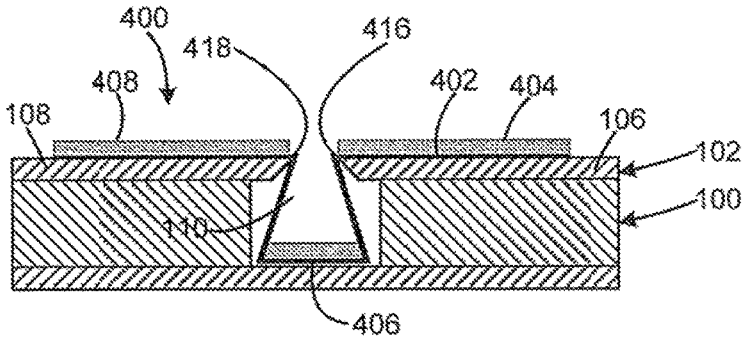
FIG. 8D illustrates a cross-sectional view of one example of the case after creasing the cover using the creasing tool.

FIG. 8D illustrates a cross-sectional view of one example of case 400 after creasing cover 402 using creasing tool 100. Both sides of case 400 are opened such that first surface board 404 is pressed against first plate 106 and second surface board 408 is pressed against second plate 108. This creases cover 402 at the edge of first plate 106 at 418 and at the edge of second plate 108 at 418. In one example, the paper-like sheet of cover 402 is perforated at 416 and 418 to reduce the stress on cover 402 at creases 416 and 418. The sides of case 400 can then be brought back together and the case removed. A spring spine or other suitable mechanism for holding the pages of a custom book may then be attached to case 400.

The following FIGS. 9A-9D illustrate one example of a process for creasing a cover of a case using creasing tool 200 previously described and illustrated with reference to FIG. 4.

Figure 9A:
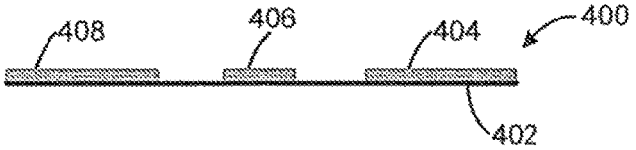
FIG. 9A illustrates a cross-sectional view of one example of a case including a cover prior to creasing the cover.

FIG. 9A illustrates a cross-sectional view of one example of a case 400 including a cover 402 prior to creasing the cover 402. Case 400 includes a first surface board 404, a spine board 406, a second surface board 408, and cover 402. Cover 402 is bonded to first surface board 404, spine board 406, and second surface board 408 via an adhesive material. In one example, cover 402 includes a transparent sheet, a paper-like sheet (or another suitable flexible material) holding first surface board 404, spine board 406, and second surface board 408 together, and a custom printed sheet between the transparent sheet and the paper-like sheet. The transparent sheet may be wrapped to form a pocket into which the custom printed sheet may be inserted. In one example, the custom printed sheet is a photo for a photo-book cover. In one example, the transparent sheet is laminated over the custom printed sheet, the paper-like sheet, first surface board 404, spine board 406, and second surface board 408 to provide a professional looking custom wrapped hardboard case for a photo-book or other custom book.

Figure 9B:
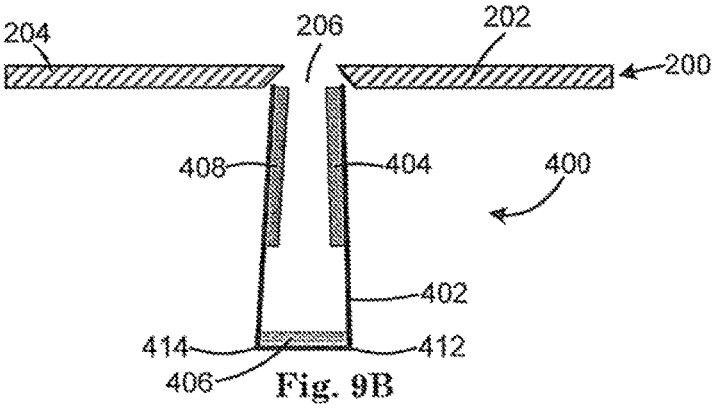
FIG. 9B illustrates a cross-sectional view of one example of the case after creasing the cover at the edges of the spine board and prior to inserting the case into a creasing tool.

FIG. 9B illustrates a cross-sectional view of one example of case 400 after creasing cover 402 at the edges of spine board 406 and prior to inserting case 400 into creasing tool 200. The case is folded into a U-shape such that a first crease is formed at 412 at a first edge of spine board 406 and a second crease is formed at 414 at a second edge of spine board 406. In one example, the paper-like sheet of cover 402 is perforated at 412 and 414 to reduce the stress on cover 402 at creases 412 and 414. In one example, cover 400 is folded into the U-shape by hand. The case is then aligned below slot 206 of creasing tool 200 so that the case can be inserted into slot 206 from the lower side of creasing tool 200.

Figure 9C:
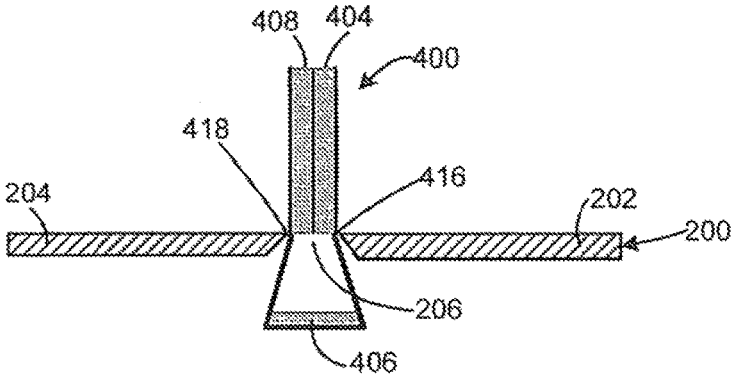
FIG. 9C illustrates a cross-sectional view of one example of the case after inserting the case into the creasing tool.

FIG. 9C illustrates a cross-sectional view of one example of case 400 after inserting case 400 into creasing tool 200. Case 400 is inserted into slot 206 of creasing tool 200 such that spine board 406 is on one side of slot 206 below creasing tool 200 and first surface board 404 and second surface board 408 are on the other side of slot 206 above creasing tool 200. First surface board 404 and second surface board 408 are substantially perpendicular to spine board 406, which is substantially parallel to creasing tool 200. Due to slot 206, spine board 406 and the portion of cover 402 below creasing tool 200 form a triangular shape that assists in aligning cover 402 within creasing tool 200. In this way, the edge of first plate portion 202 contacts one side of cover 402 at 416 at or below the inner end of first surface board 404. Likewise, the edge of second plate portion 204 contacts the other side of cover 402 at 418 at or below the inner end of second surface board 408.

Figure 9D:
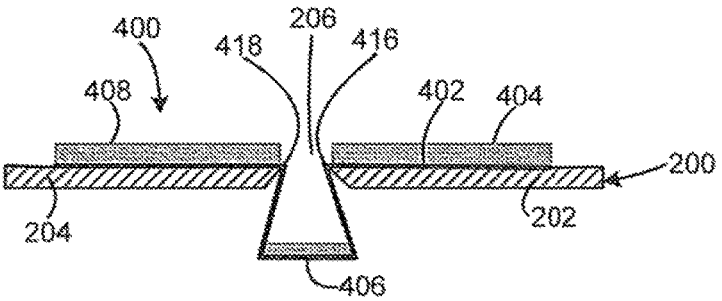
FIG. 9D illustrates a cross-sectional view of one example of the case after creasing the cover using the creasing tool.

FIG. 9D illustrates a cross-sectional view of one example of case 400 after creasing cover 402 using creasing tool 200. Both sides of case 400 are opened such that first surface board 404 is pressed against first plate portion 202 and second surface board 408 is pressed against second plate portion 204. This creases cover 402 at the edge of first plate portion 202 at 416 and at the edge of second plate portion 204 at 418. In one example, the paper-like sheet of cover 402 is perforated at 416 and 418 to reduce the stress on cover 402 at creases 416 and 418. The sides of case 400 can then be brought back together and the case removed. A spring spine or other suitable mechanism for holding the pages of a custom book may then be attached to case 400.

Examples of the disclosure provide a creasing tool for creasing a cover of a case for a professional looking custom wrapped hardboard photo-book or other custom book. The creasing tool enables a cover to be creased on both sides simultaneously and ensures straight creases in a single step. The creasing tool is low cost, easy to use, and suitable for use in a retail environment by unskilled workers.

Although specific examples have been illustrated and described herein, it be appreciated by those of ordinary skill in the art that a variety of alternate and/or equivalent implementations may be substituted for the specific examples shown and described without departing from the scope of the present disclosure. This application is intended to cover any adaptations or variations the specific examples discussed herein. Therefore, it is intended that this disclosure be limited only by the claims and the equivalents thereof.

What is claimed is:

1. A creasing tool comprising:

a first plate portion having a first edge and a first notched region at one end of the first edge; and a second plate portion having a second edge and a second notched region at one end of the second edge, the second plate portion parallel to the first plate portion such that the first plate portion and the second plate portion define a slot between the first edge of the first plate portion and the second edge of the second plate portion for creasing a cover of a case and the first notched region is directly opposite to the second notched region to provide a V-shaped guide to the slot for sliding a cover of a case first into the V-shaped guide and then into the slot.

2. The creasing tool of claim 1, wherein the first plate portion is coupled to a first base portion and the second plate portion is coupled to a second base portion, the second base portion spaced apart from the first base portion such that a spine board of the case is receivable between the first base portion and the second base portion.

3. The creasing tool of claim 1, wherein the first edge of the first plate portion is beveled and the second edge of the second plate portion is beveled.

4. The creasing tool of claim 1, wherein the first edge of the first plate portion is for providing two creases in the cover of the case, and wherein the second edge of the second plate portion is for providing another two creases in the cover of the case.

5. A creasing tool comprising:

a first plate having an edge; and a second plate having an edge, the second plate parallel to the first plate such that the edge of the first plate and the edge of the second plate define a slot between the first plate and the second plate;

a first base portion coupled to the first plate such that the edge of the first plate overhangs the first base portion;

a second base portion coupled to the second plate such that the edge of the second plate overhangs the second base portion; and a third base portion coupled to the first base portion and to the second base portion such that the first base portion, the second portion, and the third base portion define a channel substantially centered below the slot, wherein sidewalls of the channel are defined by the first base portion and the second base portion, and a bottom of the channel is defined by the third base portion, and wherein the channel is open at one end of the first plate, the second plate, the first base portion, and the second base portion such that a cover is slidable into the channel through the open end between the sidewalls of the channel and between the bottom of the channel and the slot.

6. The creasing tool of claim 5, wherein the edge of the first plate comprises a beveled edge and the edge of the second plate comprises a beveled edge.

7. The creasing tool of claim 5, wherein the first base portion and the second base portion comprise a foam material.

8. The creasing tool of claim 5, wherein the first plate comprises a notched region at the open end of the channel, and wherein the second plate comprises a notched region at the open end of the channel, the notched region of the second plate directly opposite the notched region of the first plate to provide a V-shaped guide to the slot.

9. The creasing tool of claim 5, wherein the first plate comprises a nipping portion extending from the edge of the first plate, wherein the second plate comprises a nipping portion extending from the edge of the second plate, and wherein the nipping portion of the first plate is directly opposite the nipping portion of the second plate.

10. The creasing tool of claim 5, wherein the edge of the first plate comprises a pattern of recessed portions and nipping portions, wherein the edge of the second plate comprises a pattern of recessed portions and nipping portions, and wherein the pattern of the edge of the first plate is opposite to the pattern of the edge of the second plate.

* * * * *